United States Patent [19]

Welsch et al.

[11] 3,930,343

[45] Jan. 6, 1976

[54] DEVICE FOR MOUNTING SPECIMENS

[75] Inventors: Detlef Welsch, Rathenow-Ost; Horst Waschull, Rathenow, both of Germany

[73] Assignee: VEB Rathenower Optische Werke, Rathenow, Germany

[22] Filed: Mar. 4, 1974

[21] Appl. No.: 447,684

[52] U.S. Cl. ..... 51/131; 51/216 T; 51/237 R

[51] Int. Cl.[2] ..... B24B 37/04

[58] Field of Search ..... 51/129, 131, 132, 133, 51/216 T, 237; 74/206, 212

[56] References Cited

UNITED STATES PATENTS

| | | | |
|---|---|---|---|
| 2,708,837 | 5/1955 | Leotta | 74/212 X |
| 2,839,877 | 6/1958 | Boettcher | 51/131 |
| 2,842,906 | 7/1958 | Carter | 51/131 X |
| 3,570,188 | 3/1971 | Ebner | 51/131 X |
| 3,699,722 | 10/1972 | Davidson | 51/131 X |

*Primary Examiner*—Al Lawrence Smith
*Assistant Examiner*—Nicholas P. Godici
*Attorney, Agent, or Firm*—Tab T. Thein

[57] ABSTRACT

Device for mounting specimens for the purpose of lapping, grinding and polishing metallographic specimens for microscopic analyses, comprising a rotatable polishing wheel with a number of specimen holders disposed thereabove, a driving roller centrally located with respect to the wheel and at least one supporting roller for each specimen holder, the rollers having wedge grooves engaged by peripheral edge portions of the specimen holders, and adjustable pressing members in the specimen holders for exerting pressure on the specimens and for maintaining proper frictional contact between the wedge grooves and the peripheral edge portions which constitute a frictional drive.

7 Claims, 2 Drawing Figures

DEVICE FOR MOUNTING SPECIMENS

Figure 2:
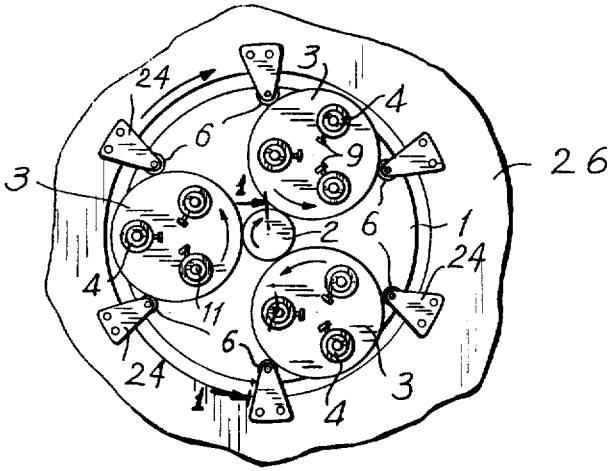

The invention relates to a device for mounting, loading and guiding specimens for the mechanical processing of planar surfaces by lapping, grinding and polishing, particularly for preparing metallographic specimens for microscopic analyses.

It is known to treat several metallographic specimens simultaneously on a horizontally rotating polishing wheel or disc so that they perform a rotation with respect to the axis of the wheel, in addition to a rotation about the own axis of each specimen holder. The purpose of this arrangement is to have each point of the specimen surface to be treated attacked up to the completion of the operation continually with different points of the polishing wheel and from different directions.

One of the solutions, for example, consisted in driving the specimen holders by the intermediary of a transmission, by way of studded discs or gears, directly from the polishing wheel, or by means of a separate motor which is adjustable as to its speed and sense of rotation. These structures allow the individual or autorotation of the specimens to be controlled to some extent but they are rather costly and complicated.

It is also known to make the specimen holders perform a swinging or pendulum movement in addition to the autorotation, namely by using a separate eccentric drive. This solution, attempting to achieve favorable kinematic conditions, has not obtained general acclaim on account of the relatively complicated operating mechanism.

With a view to increasing the polishing effect and thus the shortening of the polishing time, the known devices also provide the pressing of the specimens toward the polishing-wheel surface by additional masses or springs, the latter being braced against or supported by the housing of the devices.

Besides the explained disadvantages, the known solutions have the further drawback that no provisions are made to counteract the formation of uneven specimen surfaces which result from pitching or pull-out moments on the specimen holders or on the specimens themselves, caused by centrifugal and frictional forces. This circumstance can be most unfavorable on the results because it is not always possible exactly to coordinate or counterbalance the ratios between masses, frictional forces, and performed movements.

On the other hand holders in which the specimens are rigidly clamped, without the possibility of a pull-out torque occurring, are complicated in their use and require very careful cleaning of the entire equipment or device when switching from one grinding or polishing stage to the next.

Particularly in the technology of lapping it is known to correlate geometric conditions of size with kinematic conditions so that, at any given moment, substantially identical amounts of material are removed from all points of the specimen surfaces, ensuring substantially uniform wear of the lapping wheels or discs. This insight or knowledge has not been used so far when preparing specimens for metallography.

It is therefore an object of the present invention to eliminate the described disadvantages and drawbacks as far as possible. The invention aims at providing a simple yet reliable structure for driving specimen holders, for the additional loading of the specimens, for their uniform material removal, for a uniform wear of the working wheels, and for the elimination of pitching moments becoming effective.

According to important features of the invention, the device for mounting specimens comprising the usual housing, rotatable polishing wheel, a driving roller in the center of the wheel, and a number of specimen holders disposed above the wheel, there is provided at least one supporting roller for each specimen holder, both the driving roller and the supporting rollers having wedge grooves engaged by peripheral edge portions of the specimen holders at spaced-apart locations, these parts constituting a frictional drive for rotating the holders, and a number of adjustable pressing members for the specimen holders, for exerting pressure on the associated specimens, and also for maintaining proper contact between the parts that constitute the frictional drive.

Other, optional and secondary features of the invention will become clear from the specification.

It should be mentioned at this point that the present invention is related to some extent to the simultaneously filed patent application of the inventors W. Lorenz and H. Struebig, titled "Device for making Sections and Specimen Supports Therefor", Ser. No. 447,655.

Figure 1:
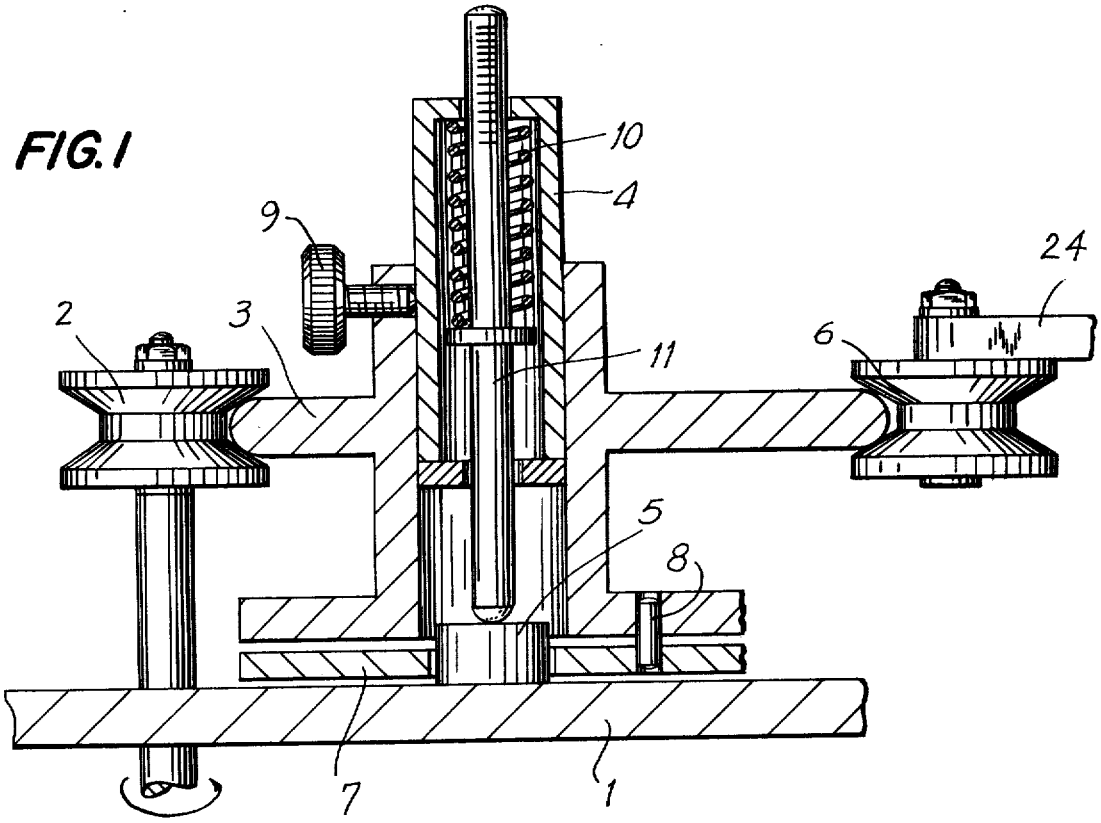

Other objects and many of the attendant advantages of the invention will be readily appreciated as the same becomes better understood by reference to the following detailed description, when considered with the accompanying drawing, wherein:

FIG. 1 is a partly sectional front view of a specimen holder or support forming part of the inventive device for mounting specimens, corresponding to a section line 1 — 1 in FIG. 2; and FIG. 2 is a somewhat schematic overall top view of the inventive device (somewhat similar to FIG. 1 of the above-mentioned co-pending application).

The inventive device for mounting specimens has therein a polishing wheel or disc 1 which has in its center a fixed driving roller 2 rotating together with the wheel. It is however contemplated to have the roller loosely mounted or separately driven. It will be seen from the correlation of FIGS. 1 and 2 that FIG. 1 shows the structure of one specimen holder or support 3 in the overall arrangement of FIG. 2, the former constituting the right-hand half of a diametral section of FIG. 2, as viewed from the left-hand side of the drawing.

The invention contemplates independent drives for wheel 1 and roller 2, in which case the rotational speeds are recommended to have a ratio of between 1 to 0.34 and 1 to 0.44.

Roller 2 has a wedge groove or keyway which receives an appropriately shaped peripheral edge portion of a number of the specimen holders 3 (e.g. three, as shown), thereby providing a frictional coupling. In the present preferred exemplary embodiment, the edges of holders 3 are rounded as shown but it should be understood that they can have quadratic, prismatic or other profiled sections, with a view to providing good frictional contact.

The required surface pressure is transferred to a pressing member 4 in each holder or support 3, under which a specimen 5 is removably disposed. At one or more locations (of which two are shown in FIG. 2 for each holder), spaced-away from roller 2 preferably in a symmetrical arrangement, supporting rollers 6 are used which are carried by arms 24 rigid with a housing portion 26 of the inventive device (further particulars of support arms 24 and the mechanism associated therewith appear in the co-pending application).

In the exemplary embodiment, the three holders 3 are symmetrically arranged above wheel 1, and there may be several, preferably three, pressing members 4 and corresponding specimens 5 in each of them, as shown. Supporting rollers 6 have wedge grooves similar to that of roller 2, and they serve to keep holders 3 stationary while they rotate about their own axes.

Specimens 5 are held and entrained during the autorotation of holders 3 by means of a specimen cage 7 having the same number of bores as there are pressing members 4 in each holder 3. Two driver pins 8 (of which only one is shown), interconnecting each specimen holder 3 with cage 7, ensure autorotation of the latter. In FIG. 2, arrows show the rotation of wheel 1 and of holders 3 although that of pressing members 4 has been omitted for the sake of clarity.

Each pressing member 4 has therein a knurled adjusting screw 9 for immobilizing the member in various vertical positions with respect to the associated specimen holder 3. Compression springs 10 within members 4 urge pressing bolts 11 toward the specimens therein. It can be seen from FIG. 1 that the upper ends of springs 10 rest against the inner top ends of members 4 while their lower ends urge downward respective flanges or enlargements of bolts 11. Each screw 9 allows vertical positioning and fixing of the associated member 4 with respect to the surrounding holder 3.

A partition with an appropriate aperture can be provided in the latter for centering bolt 11, at a location below the lowermost working position of member 4.

It will be understood by those skilled in the art that the pressure of springs 10 is distributed among respective specimens 5 and the upper frictional engaging surfaces of holders 3 with central driving roller 2, on the one hand, and with an appropriate number of peripherally disposed supporting rollers 6, on the other.

To this end, the invention also contemplates providing the upper wedge-groove areas in rollers 2 and/or 6, and/or the upper peripheral edges of holders 3, with special profiles which ensure good frictional engagement therebetween while limiting undue wear.

It should be understood, of course, that the foregoing disclosure relates only to preferred embodiments of the invention, and that it is intended to cover all changes and modifications of the examples and features described which do not constitute departures from the spirit and scope of the invention.

We claim:

1. A device for mounting specimens for the purpose of lapping, grinding and polishing metallographic specimens for microscopic analyses, comprising: a housing; a rotatable polishing wheel therein; a driving roller disposed centrally with respect to said wheel; at least one specimen holder disposed above said wheel, for receiving specimens therein to be ground and polished by a surface of said wheel; at least one supporting roller, associated with said housing, for said specimen holder; said driving roller and said supporting roller having wedge grooves therein, engaged by a peripheral edge portion of said specimen holder at spaced-apart locations; said wedge grooves and said edge portions constituting members of a frictional drive, for rotating said specimen holder; and at least one adjustable pressing member in the latter for exerting pressure on the associated specimen, and also for maintaining proper contact between said members of the frictional drive; wherein said at least one pressing member includes a slidable portion, means for immobilizing said slidable portion in various operative positions, a pressing bolt within said slidable portion in contact with the specimen, for exerting pressure thereon, and means for biasing said bolt toward the specimen, and also the associated specimen holder toward said wedge grooves of the respective rollers, by the intermediary of said pressing member.

2. The device as defined in claim 1, further comprising means for rotating said wheel and said specimen holder at a ratio of between 1 to 0.34 and 1 to 0.44.

3. The device as defined in claim 1, wherein said specimen holder has therein three of said pressing members.

4. The device as defined in claim 1, further comprising a specimen cage having the same number of bores therein as said pressing members in said specimen holder, and a driver pin for interconnecting said cage with said specimen holder.

5. The device as defined in claim 1, further comprising a partition within said specimen holder, below said slidable portion, for guiding said pressing bolt into substantially central contact with the specimen.

6. A device for mounting specimens for the purpose of lapping, grinding and polishing metallographic specimens for microscopic analyses, comprising: a housing; a rotatable polishing wheel therein; a driving roller disposed centrally with respect to said wheel; at least three specimen holders disposed above said wheel, for receiving specimens therein to be ground and polished by a surface of said wheel; at least one supporting roller, associated with said housing, for each of said specimen holders; said driving roller and said supporting rollers having wedge grooves therein, engaged by peripheral edge portions of said specimen holders at spaced-apart locations; said wedge grooves and said edge portions constituting members of a frictional drive, for rotating said specimen holders; and at least three adjustable pressing members in the latter for exerting pressure on the associated specimens, and also for maintaining proper contact between said members of the frictional drive; wherein said pressing members include a slidable portion, means for immobilizing said slidable portion in various operative positions, a pressing bolt within said slidable portion in contact with one of the specimens, for exerting pressure thereon, and means for biasing said bolt toward the specimen, and also the associated one of said specimen holders toward said wedge grooves of the respective rollers, by the intermediary of said pressing member.

7. The device as defined in claim 6, further comprising a partition within each of said specimen holders, below said slidable portions, for guiding said pressing bolt into substantially central contact with the one specimen.

* * * * *